United States Patent [19]

Schmitt

[11] 4,412,365

[45] Nov. 1, 1983

[54] BRUSH

[75] Inventor: Wilhelm E. Schmitt, Le Grange Park, Ill.

[73] Assignee: Jack S. Friedman, Highland Park, Ill.

[21] Appl. No.: 294,361

[22] Filed: Aug. 19, 1981

Related U.S. Application Data

[63] Continuation-in-part of Ser. No. 782,176, Mar. 28, 1977, abandoned, and Ser. No. 802,793, Jun. 2, 1977, abandoned, and Ser. No. 90,101, Nov. 1, 1979, abandoned.

[51] Int. Cl.[3] ..... A46B 7/00; A46B 9/02; A46B 17/06

[52] U.S. Cl. ..... 15/184; 15/169; 15/186; 132/121

[58] Field of Search ..... 15/169, 184, 186, 187, 15/188; 132/123, 143, 121

[56] References Cited

U.S. PATENT DOCUMENTS

| | | | |
|---|---|---|---|
| 220,297 | 10/1879 | Lovejoy | 15/186 |
| 676,358 | 6/1901 | Fockens | 119/88 |
| 1,518,480 | 12/1924 | Buchanon | 15/186 |
| 2,052,836 | 9/1936 | Lowy | 15/186 |
| 2,110,294 | 3/1938 | Gessner | 132/143 X |
| 2,718,024 | 9/1955 | Maynard | 15/186 |
| 2,783,490 | 3/1957 | Kutik | 15/187 |
| 3,230,561 | 1/1966 | Taccone | 15/186 X |
| 4,001,910 | 1/1977 | Peilet | 15/184 |
| 4,023,230 | 5/1977 | Freidman | 15/169 X |
| 4,062,083 | 12/1977 | McKay | 15/184 |

FOREIGN PATENT DOCUMENTS

| | | | |
|---|---|---|---|
| 2132972 | 1/1973 | Fed. Rep. of Germany | 15/169 |
| 2294665 | 7/1976 | France | 15/169 |

*Primary Examiner*—Peter Feldman

*Attorney, Agent, or Firm*—Dressler, Goldsmith, Shore, Sutker & Milnamow, Ltd.

[57] ABSTRACT

A brush in which the individual bristles are arranged in clusters so that the bristles are parallel to one another and perpendicular to the brush body for improved gathering and aligning of hair without damage thereto. One embodiment also has a casing having a panel with a plurality of openings extending therethrough, a cradle member positioned within the casing carrying a plurality of elongate support members with thread-like monofilament bristles attached thereto. Each of the bristles extends into one of the openings in the panel in a close-fitting relationship. The embodiment also includes means to retract the bristles into the casing through the openings whereby the close fitting relationship between the openings and the monofilament bristles exert a scraping action to the bristles to clean them of any foreign matter adhering thereto.

26 Claims, 23 Drawing Figures

128
124
9.
128a
106
100
9.

106
130
124
128
134
126
134
120
116
132
118
122
118
122
110
112
112
112
112
104
114
100

BRUSH

DESCRIPTION

This is a continuation-in-part of application Ser. No. 782,176, filed Mar. 28, 1977, now abandoned, and of application Ser. No. 802,793, filed June 2, 1977, also now abandoned, and of copending application Ser. No. 90,101, filed Nov. 1, 1979, now abandoned.

TECHNICAL FIELD

This invention relates to bristle brushes, and a preferred form of the invention relates particularly to a bristle brush for use with human hair.

BACKGROUND OF THE INVENTION

Conventional hairbrushes include a plurality of tufts. Each tuft consists of a plurality of bristles, and the bristles are secured together at one end thereof to form the tuft. As a result, the bristles of each tuft diverge outwardly relative to one another from their secured ends. The spaced free ends of the bristles can pass freely through the hair; however, the bristles converge toward one another at their secured ends, and this causes pinching and pulling out of the hair. Molded pin-type brushes are also known, but in such brushes the bristles are tapered and spaced a relatively great distance from one another, so as to be inefficient in terms of gathering and aligning of hair.

Over the years, attempts have been made to provide a bristle brush which is compact and does not expose the brush bristles during storage. One brush of this type is described in U.S. Pat. No. 2,427,559 in which the brush bristles are mounted on a movable back which can be displaced into the protective casing so that, in the closed position, the bristles of the brush are not exposed. Brushes of this type are desirable since the retraction of the bristles into the casing provides a compact brush, and the bristles are not exposed to damage fabrics and like materials with which the bristles come into contact. Other retractable bristle devices are described in U.S. Pat. Nos. 3,065,757, 3,148,685, 3,765,049 and a host of other patents.

One of the difficulties of brushes of the type described in the above-identified patents stem from the fact that the bristles entrap dirt, dust, hair and other foreign material, which is drawn into the casing by entrapment with the bristle tufts. After use, the brush becomes laden with such foreign material which is difficult to remove.

It would be desirable to provide a brush that does not suffer from the above-described disadvantages and that obviates the above-described problems.

SUMMARY OF THE INVENTION

In accordance with the present invention, a brush is provided with monofilament bristles arranged in a fashion which provides improved gathering and aligning of hair, without attendant damage thereto.

In one embodiment of the invention, the brush has retractable bristles that can conveniently be cleaned without damage thereto. The brush is simple in construction, economical to produce, and is long-lasting. The bristles are cleaned in response to use and are thus maintained in a sanitary condition. The brush is reducible to a small compact unit in which both the bristles and the handle are retracted to form a portable, compact unit when not in use.

The brush of the present invention obviates the problems noted above in connection with tufted and molded pin-type brushes, since the bristles are parallel with one another in the operative position, and do not create converging pressure points which can pinch and pull out hair.

BRIEF DESCRIPTION OF THE DRAWINGS

These and other objects and advantages of the invention will appear more fully hereinafter, and for purposes of illustration, but not of limitation, an embodiment of the invention is shown in the accompanying drawings wherein.

DESCRIPTION OF THE PREFERRED EMBODIMENTS

Figure 1:
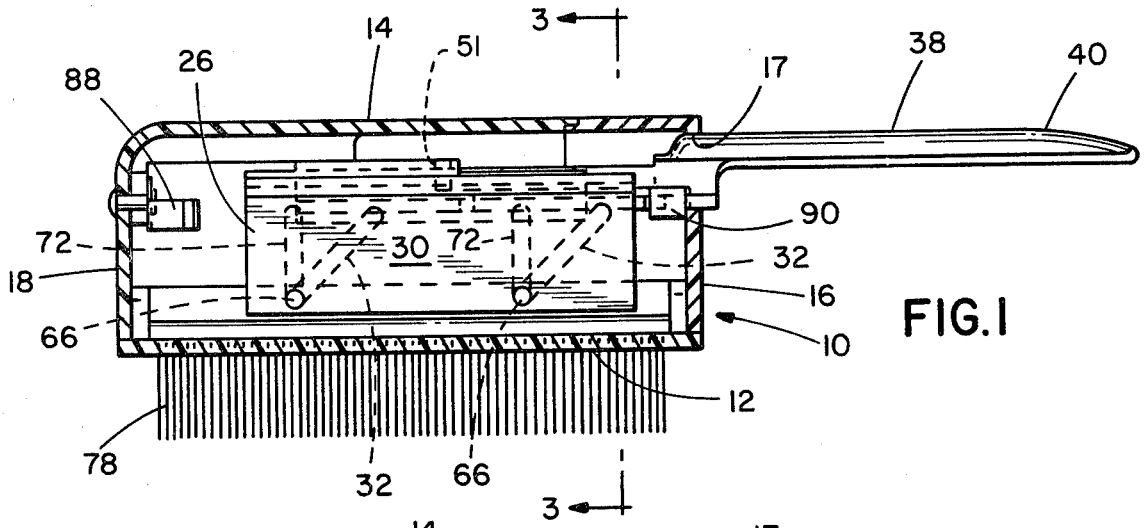
FIG. 1 is a sectional view in elevation illustrating a retractable-bristle brush embodying the features of this invention with the bristles being in the extending or down position.

The concepts of one embodiment of the present invention reside in a retractable-bristle brush in which the bristles are in the form of monofilaments preferably of uniform cross section throughout their length and in one embodiment are carried on a rotatable support mounted for retraction into the casing. As the handle is displaced toward a concealed position the bristles are retracted into the casing, each monofilament bristle is withdrawn through its own opening in the casing in such a way that little or no entrapped hair, dirt or other foreign material can be retracted into the casing. That enables the bristles to be cleaned by simply retracting the bristles into the casing whereby substantially all foreign material adhering thereto remains on the facing of the casing for easy and simple cleaning. Thus, the openings in the casing through which the bristles are withdrawn act as a scraper to clean each monofilament bristle, or otherwise remove foreign material therefrom.

Referring now to the drawings for a more detailed description of the invention, there is shown in the drawings a retractable-bristle brush including a casing 10 provided with a foraminous or perforated panel 12, a top panel 14 and end panels 16 and 18, respectively. Closing off the casing are a pair of spaced opposing side panels 20 which are preferably integral with the end panels 16 and 18. In an exemplary form of the invention, as is perhaps most clearly shown in FIG. 4 of the drawing, at least a portion of the top panel 14 is removable to provide access to the interior of the casing for cleaning purposes.

The casing defines a pair of opposing, elongate slots 22 adapted to receive elongate flange members 24 of a slotted wing member 26, adapted to be slidably engaged in the elongate slots 22. The slotted wing member 26 has a generally U-shaped cross section formed of a top panel generally shown as 28 and a pair of spaced and opposing side panels 30, each of which defines a pair of inclined guide slots 32. The top panel 28 of the slotted wing member 26 also defines a central panel 34 formed by a domed panel 36 adapted to receive the handle member 38. The handle member 38 is formed of an elongate handle 40 and a slide 42 defining a longitudinal guide slot 44, a forward locking notch 46 and a rearward locking notch 48. In the embodiment illustrated in the drawing, the slide 42 has a curved surface 50, providing the slide with a cross section corresponding to the configuration of the domed panel 36 so that the slide 42 can be received in the central opening of the slotted wing 26. In the embodiment shown in the drawing, once the slide 42 has been inserted in the central opening 34 of the slotted wing 26, a locking rivet 51 is inserted into an opening 52 therefor in the domed panel 36, the locking rivet extending in the longitudinal guide slot 44 to secure the slide 42 in the central opening 34. With the handle in the extended position, the locking rivet 51 abuts the leading edge 54 of the guide slot 44 to prevent removal of the slide 42 from the central opening 34.

Figure 5:
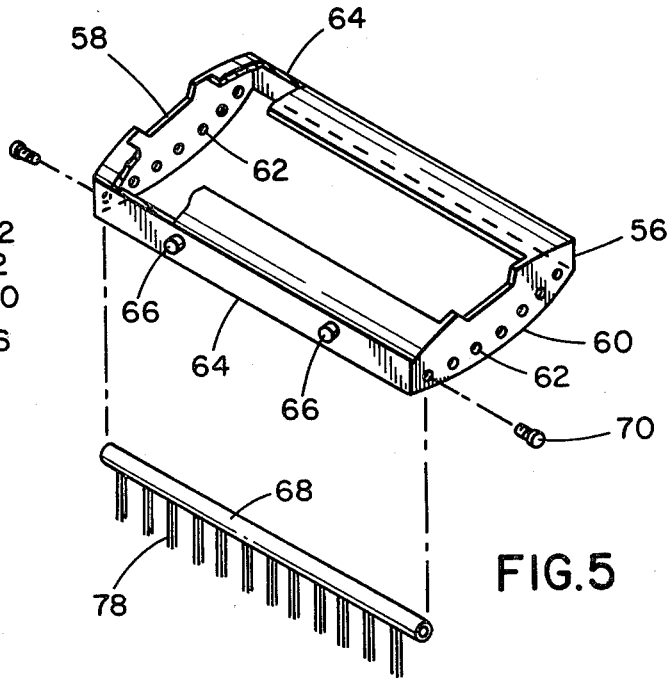
FIG. 5 is a perspective view of the cradle carrying the bristles of the brush of this invention.

The brush of this invention also includes a cradle member 56 (as shown in FIG. 5) having a frame composed of parallel-spaced end walls 58 and 60, respectively, each of which contains a plurality of openings 62 extending therethrough. The cradle also includes longitudinal frame elements 64, each of which carries a pair of cam pins 66.

Figure 3:
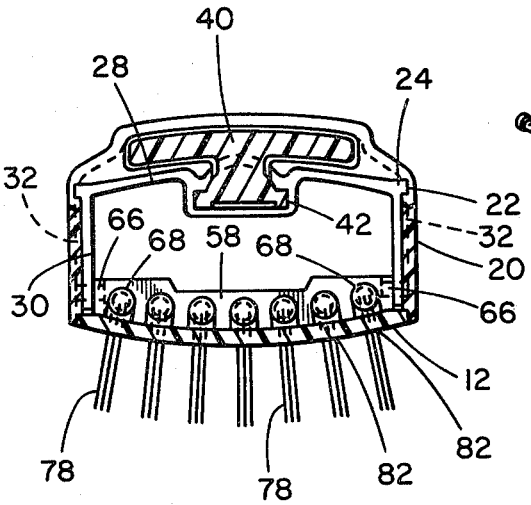
FIG. 3 is a sectional view taken along the line 3—3 of FIG. 1.

As is most clearly shown in FIGS. 3 and 5 of the drawings, the openings 62 of the end wall of the cradle are mounted such that the locus of their centers defines an arc. The bristles of the brush are carried on elongate members 68 mounted on the cradle 56.

It is an important concept of the invention that the elongate members 68 be rotatable with respect to the cradle 56 so that, when the monofilament bristles are retracted into the casing, as hereinafter described, the elongate members 68 rotate relative to the cradle 56 to insure that the bristles are subjected to little or no distortion. For that purpose, the length of the elongate members can be dimensioned to correspond to the space between the inner faces of the end walls 58 and 60. Thus, the elongate members are mounted to be rotatable by inserting a pin 70 through an opening 62, the pin extending into the hollow elongate members 68 to engage the elongate members 68 within the end walls of the cradle while leaving the elongate members 68 free to rotate about the pins 70. As will be appreciated by those skilled in the art, various other means can be employed to rotatably mount the elongate members on the cradle.

Figure 2:
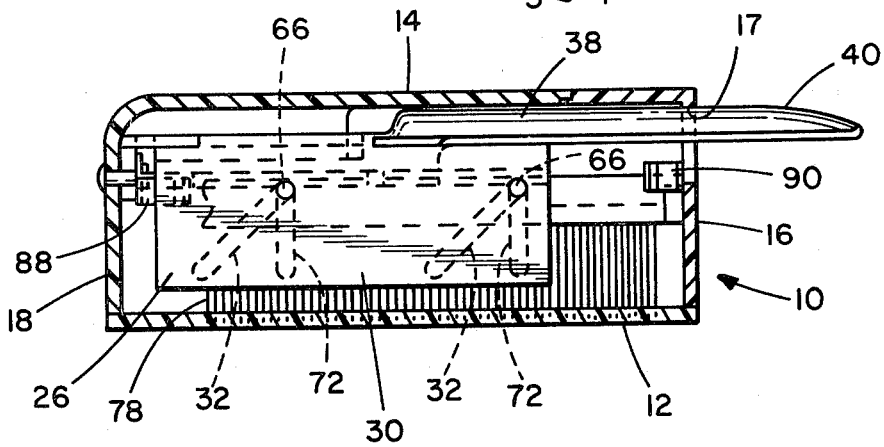
FIG. 2 is a side view in elevation like that in FIG. 1, with the bristles being retracted into the casing.

In the assembled brush, the slotted wing member 26 is positioned within the casing 10, with the elongate flange members 24 being positioned in the slots 22 permitting the slotted wing member to be slid back and forth within the casing 10. As is perhaps most clearly shown in FIGS. 1 and 2 of the drawing, the cradle is also positioned with the casing 10, with the cam pins 66 extending through the inclined slots 32 in the slotted wing member 26 and into a pair of corresponding, vertically disposed slots 72 in the interior side panels 20 of the casing 10. In this way, when the bristles of the brush are in the extended position, ready for use, as shown in FIG. 1 of the drawing, the cam pins 66 of the cradle are in the lower portion 74 of the slots 72 as well as the lower portion 76 of the inclined slots 32 in the slotted wing member 26. As the slotted wing member is advanced into the casing, as hereinafter described, the cam pins 66 are displaced, by reason of the inclined slots 32, upwardly within the slots 72 to raise the bristles 78 of the brush. That latter position, with the bristles retracted, is shown in FIG. 2 of the drawing.

As is perhaps most clearly shown in FIG. 3 of the drawing, the perforated plate or panel 12 includes a plurality of openings 82 through which one of the plurality of bristles 78 extends. Thus, as the slotted wing member is advanced into the casing to retract the bristles, each monofilament bristle is retracted through its corresponding opening 82 in the perforated panel 12, with the closely fitting relationship between the opening 82 and the monofilament bristle 78 giving rise to a cleaning action exerted on the individual monofilament 78. That prevents hair, dirt or like foreign material from being retracted into the casing of the brush. Any foreign material adhering to the bristles 78 is thus deposited on the face of the perforated panel 12 as the free ends of the bristles are raised above the lower surface of the perforated panel 12, thereby permitting a cleaning of the brush by simply wiping the foreign material from the face of the perforated panel 12.

In an exemplary embodiment of the invention, the handle 38 provides means for advancing the slotted wing member within the casing 10 to retract and extend the bristles 78 through the perforated panel 12. As indicated previously, the slide 42, integral with the handle 38, is engaged in the central opening 34 of the slotted wing member 26. As the handle 38 is advanced in a direction away from the casing 10 through an opening 17 in the end panel 16, the slide 42 is partially withdrawn from the central opening 34 until the leading edge 54 of the guide slot 44 abuts the locking rivet 51. At that point, as the handle is advanced further in a direction away from the casing 10, the slotted wing member 26 is advanced toward the end panel 16, forcing the pins downwardly in the slots 72 to extend through the perforated panel 12 the bristles of the brush. When it is desired to retract the bristles of the brush, the handle is advanced toward the casing 10, and slide 42 is advanced into the central opening 34 through the slotted wing member 26 until the stem 84 of the handle is advanced into a corresponding slot 83 in the domed panel 36. As the handle 38 is continued to be advanced inwardly, the stem 84 of the handle abuts the leading edge 86 of the slot 83 to displace the slotted wing member further into the casing. The movement of the slotted wing toward the end panel 18 serves to retract the bristles 78 through their corresponding openings 82. That latter position is illustrated in FIG. 2 of the drawing, where it can be seen that only a short portion of the handle protrudes from the casing.

In the preferred practice of this invention, the interior casing is provided with a pair of locking clips 88 and 90. The retaining clip 90 engages the notch 48 when the bristles are in the extended position (i.e., when the slide 42 has been withdrawn all the way out of the casing 10) and the locking clip 88 engages the notch 46 when the bristles are in the retracted position (i.e., when the slide has been advanced all the way into the casing 10).

As will be appreciated by those skilled in the art, there are numerous other types of means which can be used in the practice of this invention to retract and extend the bristles in and out of the casing 10. The important concept of the present invention stems from the utilization, in the present invention, of a plurality of monofilaments 78, each of which extends through its own opening 82. When the cradle 56 is raised to retract the bristles 78 through their corresponding opening 82 in the perforated panel 12, the elongate tubular members 68 in which the monofilament bristles are mounted are caused, as can best be seen in FIG. 3 of the drawing, to rotate about their longitudinal axis to insure that the bristles 78, and particularly those adjacent the side panels 20, are not subjected to excessive distortion. In that way, the bristles 78 can be retracted and extended through the openings 82 without subjecting the bristles to significant amounts of distortion which would break or fray the bristles, or otherwise render them unsuitable for such use.

It will also be apparent that the handle can be moved a substantial distance before engagement of the actuating mechanism, thereby to enable use of a longer handle without detracting from the compact character of the brush when not in use.

Figures 4, 6:
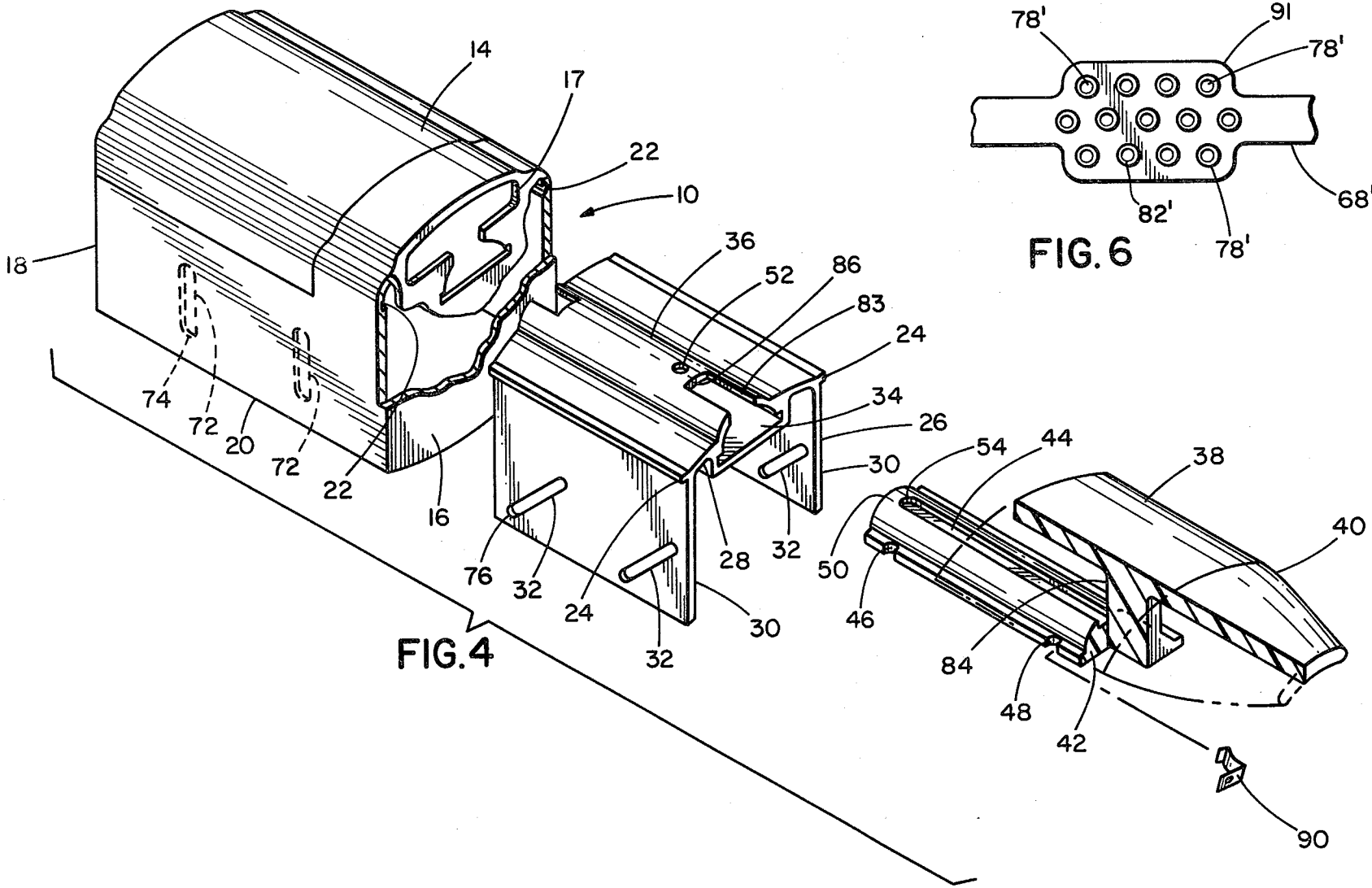
FIG. 4 is an exploded view of the embodiment illustrated in FIGS. 1–3.
FIG. 6 illustrates a pattern in which the bristles can be arranged to extend from one zone of an elongate tubular member.
Figures 7, 8:
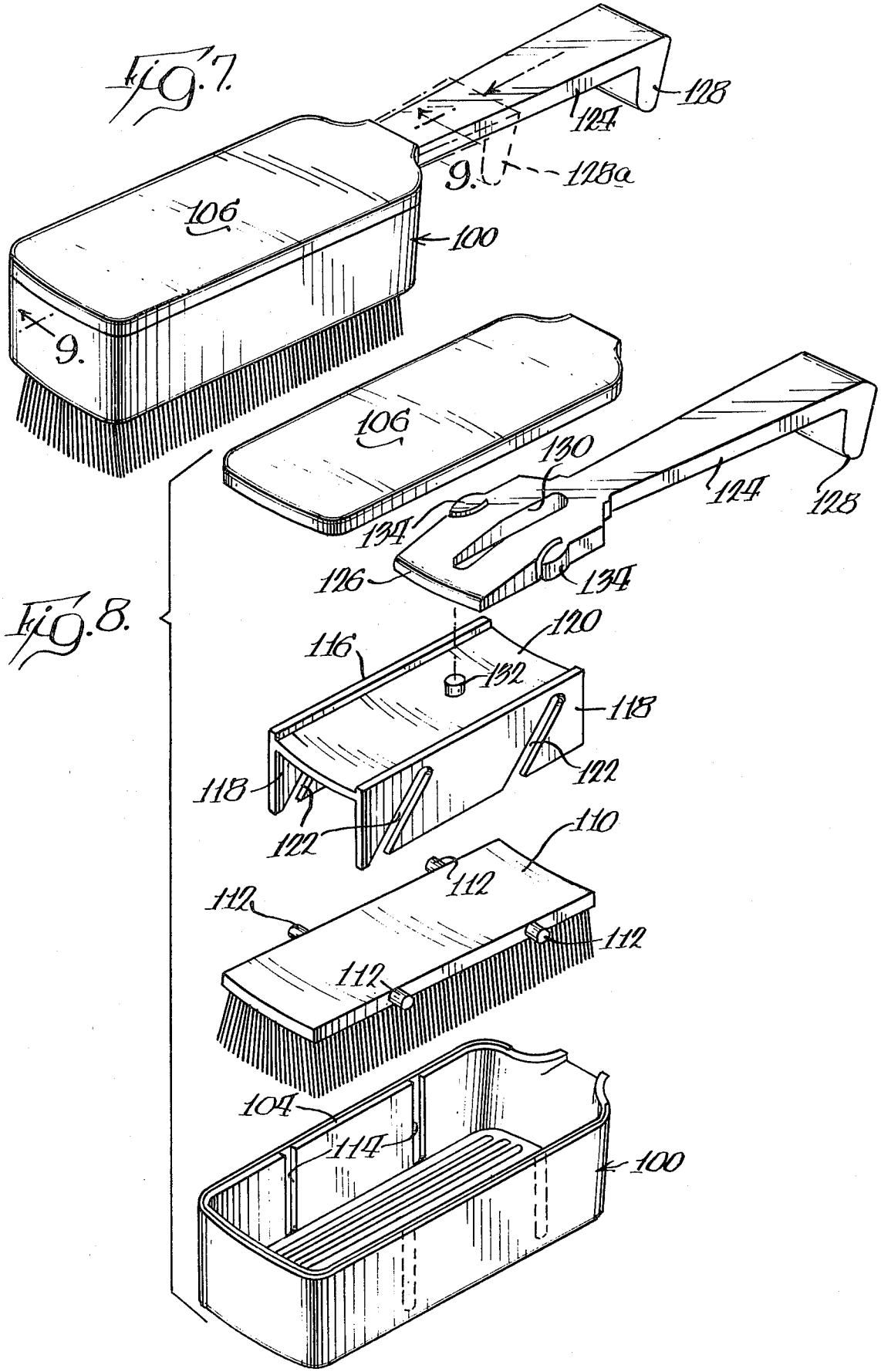
FIG. 7 is a perspective view of a further embodiment of the present invention.
FIG. 8 is an exploded perspective view of the embodiment illustrated in FIG. 7.

One possible pattern of the retractable-bristle brush of this invention is shown in FIG. 6 of the drawing. In this embodiment, the elongate support members 68' are provided with an integral area 91 of enlarged cross section to which a plurality of monofilament bristles are fixed. In this embodiment, as well as that illustrated in the other figures, use is made of monfilament bristles 78' instead of a tuft as is conventionally used in the prior art. As those skilled in the art will appreciate, the use of a monofilament in accordance with the practice of this invention facilitates the cleaning action exerted when the monofilament bristles 78' are withdrawn through their corresponding openings 82'.

The monofilament bristles employed in the practice of this invention can be formed of a variety of natural and synthetic materials, including natural fibers, as well as fibers from synthetic materials. It is an important concept in the preferred embodiment of this invention that the monofilament bristles be fibrous, thread-like monofilaments having a substantially uniform cross section. In that way, the cleaning action exerted when the bristles are retracted into the casing extends substantially over the length of the bristles to clean foreign matter therefrom. It has been found that comparable results cannot be achieved through the use of the well-known pin-type comb elements; those usually have a conical or tapered configuration, and thus any cleaning action which might be exerted on the base of the pins as the bristles are retracted is rendered ineffective in the area of the outer extremes of the pin by reason of their diminished cross section.

Referring now to the embodiment of FIGS. 7–13, many features of this embodiment are generally the same as, or identical to, the features of the previously described brush, and hence, those common features will not be described in detail. As with the previously described brush, the embodiment of FIGS. 7–13 includes a body or casing 100 defined by a bottom wall 102 and a peripherally continuous upstanding sidewall 104. A cover 106 is secured to the upper end of sidewall 104 so as to form a closed internal chamber 108 within body 100.

Figure 9:
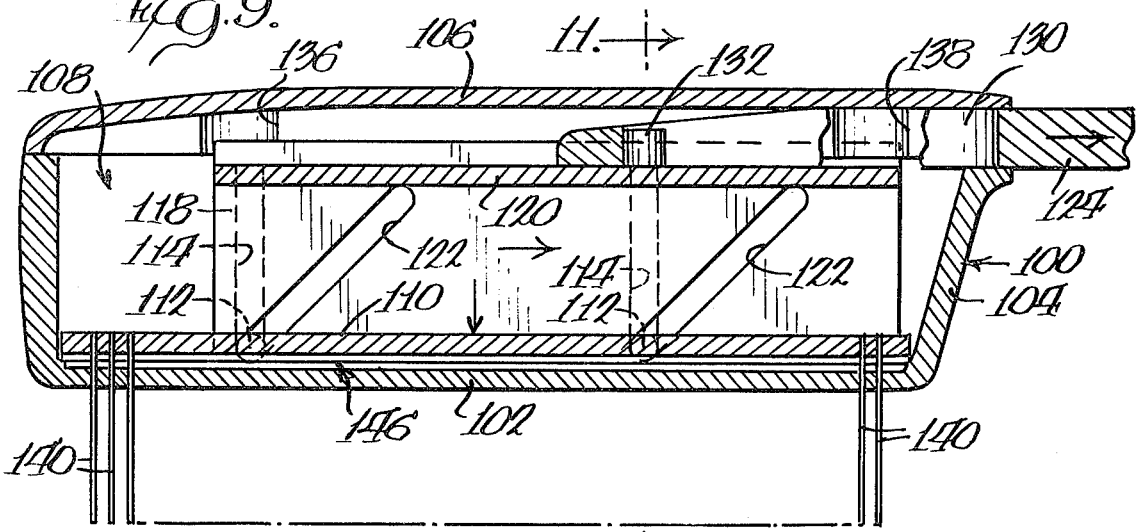
FIG. 9 is an enlarged fragmentary cross-sectional view taken generally along line 9—9 of FIG. 7, with the bristles in an extended operative position and with a portion of the handle being broken away.
Figure 10:
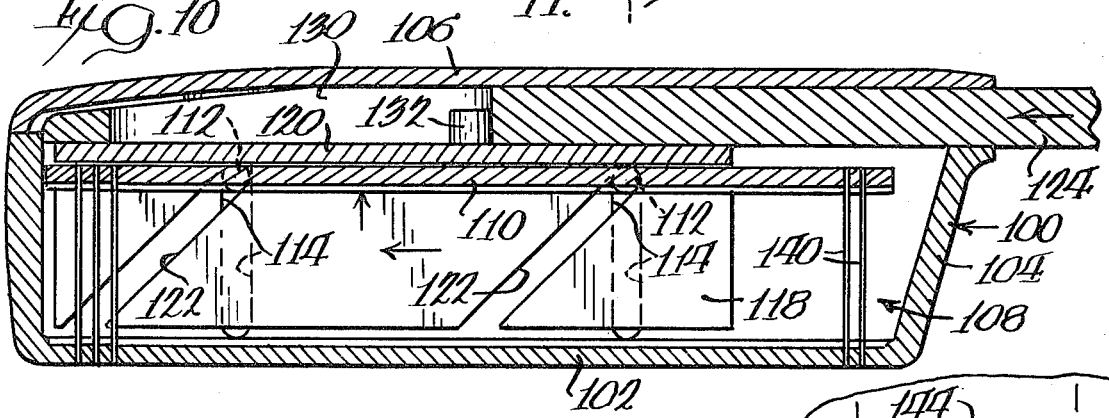
FIG. 10 is a view like FIG. 9, but showing the bristles in a withdrawn inoperative position.

A bristle holder 110 is mounted for vertical movement within chamber 108 between an extended operative position shown in FIG. 9, and a retracted inoperative position shown in FIG. 10. Bristle holder 110 is guided in its vertical movement by the cooperative action of pins 112 that extend laterally outwardly from the bristle holder, and vertical grooves 114 in the sidewall 104 of the body 100. Bristle holder 110 is moved vertically within chamber 108 by cam means in the form of a slide element 116.

Figure 11:
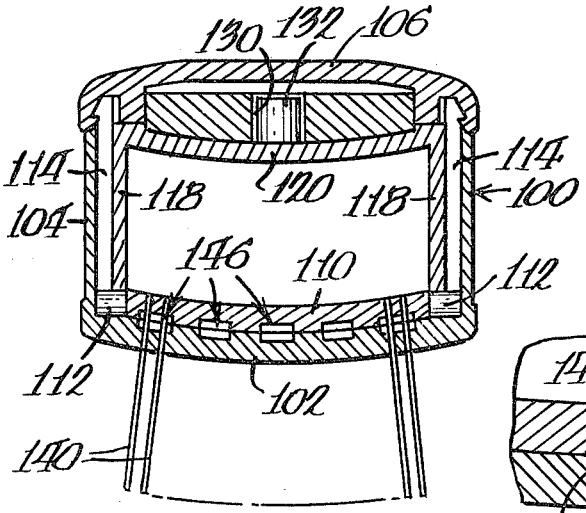
FIG. 11 is a cross-sectional view taken generally along line 11'11 of FIG. 9.

Slide element 116 is generally inverted U-shaped in cross-section, as can be best seen in FIG. 11, and includes upright side or wing members 118 spanned by a transversely extending cross member 120. Parallel inclined slots 122 are provided in side elements 118, and receive pins 112 therein for moving the bristle holder up and down as the slide element 116 is reciprocated within the cavity 108 of body 100.

As with the previously described embodiment, a handle 124 is provided to reciprocate the slide element 116 within body 100. As can best be seen in FIG. 8, handle 124 includes an enlarged head portion 126 at one end thereof, and a downwardly extending gripping portion 128 at its opposite end. Handle 124 and slide element 116 include cooperating connection means defined by an upwardly extending pin-like projection 132 on cross-element 120, and an elongate slot 130 within head portion 126. Pin 132 and slot 130 define a lost motion means, which permits the handle 124 to be moved to a compact storage position with the gripping portion (as shown in broken lines at **128*a* in FIG. 7) closely adjacent to body 100**.

Means is provided for releasably retaining the handle 124 in the extended and retracted positions, and such means includes outwardly extending ears 134 at opposite sides of head portion 126 of handle 124. Ears 134 resiliently engage aligned recesses 136 and 138 (FIG. 9), in cover 106 to releasably retain the handle in the retracted and extended positions, respectively.

A plurality of monofilament bristles 140 are carried by bristle holder 110, and each bristle 140 extends through an opening 142 in the bottom wall 102 of body 100. Bristles 140 are slender, elongate, flexible elements, preferably formed of a synthetic plastic material. In order that openings 142 can perform the desired scraping and cleaning function as the bristles 140 are retracted into the interior of the body 100, a close diametric relationship is established between bristles 140 and openings 142. Bristles that have been found to be extremely well suited for the present invention are Nylon monofilament bristles sold under the trademark TYNEX by E. I. duPont de Nemours & Co., Inc. Applicant has found that TYNEX bristles 0.020 inches in diameter are particularly useful, and that extremely satisfactory cleaning and scraping of such bristles takes place when the openings 142 have a diameter of 0.025 inches. With such an arrangement, a total radial clearance of 0.0025 inches is provided, although it is contemplated that radial clearances in the range of 0.0015–0.010 inches would be satisfactory for the purposes of the present invention. Clearances within this range enable the desired scraping action to take place while at the same time accommodating bristles which may deviate slightly in diameter and shape. When such bristles are in the extended position, as for example shown in FIG. 9, they project approximately 0.625 inches from the bottom wall 102 of the brush body. The inner ends of the bristles 140 are secured to the arcuate upper surface of bristle holder 110, which is also preferably made of a plastic material, at 140*a* (FIG. 13) by heat sealing, ultrasonic energy, solvent welding, and the like.

When bristles of the aforementioned approximate diameter and length are utilized, applicant has found that because of the flexibility and limberness of the bristles, an adequate hair aligning function will not be performed unless such bristles are positioned in closely spaced relationship to one another, so that adjacent bristles are mutually supportive of one another. Applicant has found that the brush of the present invention functions most satisfactorily if the bristles are arranged in a plurality of clusters or groups, where the clusters are spaced some distance from one another, with the individual bristles being relatively closely adjacent to one another.

The bristle clusters are identified generally by reference character 144 (FIG. 12), and in the embodiment of FIGS. 7–13 the bristle clusters are arranged into a plurality of transversely spaced, longitudinally extending rows 146 (FIG. 11). The bristle clusters in each row 146 are preferably staggered with respect to one another, so that a bristle cluster in one row is offset relative to a bristle cluster in an adjacent row, but aligned with a bristle cluster in the next adjacent row.

In a brush having bristles with the above stated diameter and length, each cluster has two outer rows of three bristles each, and a central row of four bristles, with the individual bristles in each row being spaced from one another by about 0.041 inches and with the outer rows being spaced from the central row by about 0.041 inches. Thus, with a bristle having a circular cross-section with a diameter of 0.020 inches, the ratio of the largest cross-sectional dimension of one of said bristles to the spacing between said one bristle and any closest other bristle will be about 1:2. As is evident from FIG. 12, the bristles in the outer rows are offset and centered with respect to the bristles in the central row. Imperforate land areas are defined between each cluster 144, and in the illustrated embodiment, the land areas are about 0.250 inches in length. While it is presently preferred to utilize slender, elongate flexible bristles of the above mentioned size, and to arrange such bristles into clusters as noted above, it is also contemplated that thicker (0.028 inches in diameter for example) generally self-supporting bristles may be provided, in which case it is not necessary to arrange the bristles into clusters.

Figure 13:
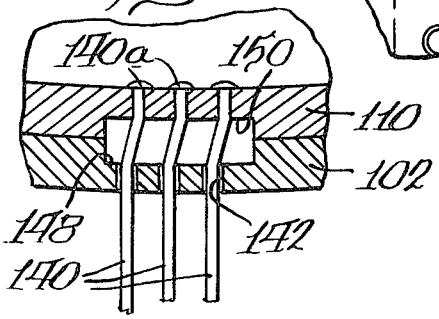
FIG. 13 is a cross-sectional view taken generally along line 13—13 of FIG. 12.

As can be best seen in FIGS. 11 and 13, the downwardly facing outer surface of bristle holder 110 is outwardly convex, whereas the upwardly facing inner surface of bottom wall 102 a body of 100 is upwardly concave. Such surfaces are positioned in surface-to-surface contact with one another, when the bristles are positioned in the extended operative position. In order to prevent kinking of the bristles, particularly the bristles in the clusters adjacent to the side edges of the brush, recess means is provided in alignment with each row 146. The recess means takes the form of an upwardly facing groove 148 in bottom wall 102 of body 100, and a downwardly facing groove 150 in the outside surface of bristle holder 110. As can be best appreciated from FIG. 13, when the bristles are in the extended position, grooves 148 and 150 define a chamber permitting the bristles to extend at an angle at openings 142, thereby preventing kinking of the bristles. As is also evident from FIGS. 9, 10 and 11, the individual bristles extend parallel to one another and perpendicular to the arcuate outer surface of brush wall 102. Since the bristles do not converge relative to one another, as in tufted brushes, no pressure points are created which would tend to pull out and harm the hair of the brush users. It should also be understood that the walls of openings 142 closely confine the bristles adjacent their secured ends, and assist in retaining the bristles parallel to one another.

Figure 12:
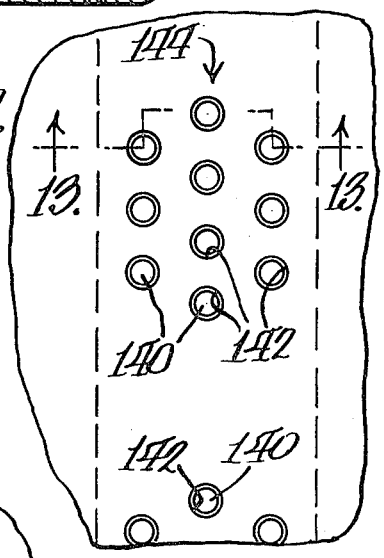
FIG. 12 is an enlarged fragmentary plan view of the bottom of the brush body showing a cluster of bristles.

It is to be realized that the cluster configuration illustrated in FIG. 12 may be modified within the scope of the teachings of the present invention.

The brush may have just one large cluster across the bottom of the brush with the openings arranged and spaced (not necessarily in rows) to provide a mutually supportive relationship among the bristles when the bristles are in the operative position and are flexed. Specifically, with such a novel design, one or more of the bristles will bend during brushing and will bear against an adjacent bristle or bristles, either directly or indirectly by forcing hair against the adjacent bristles. The bristles thus function to mutually support each other although they remain spaced apart at the bottom surface of the brush.

Further, the bristle openings in one or more clusters may be arranged in rows in each cluster so that a continuous line drawn through the openings at the outermost periphery of the cluster defines a circle, an ellipse, a square, a diamond, a hexagon, or an octagon, among other such figures. These and other cluster configurations are illustrated in detail in FIGS. 17–23 with reference to another embodiment of a brush in accordance with the principles of the present invention. Such an embodiment will next be described in detail with reference to FIGS. 14–23.

Figure 14:
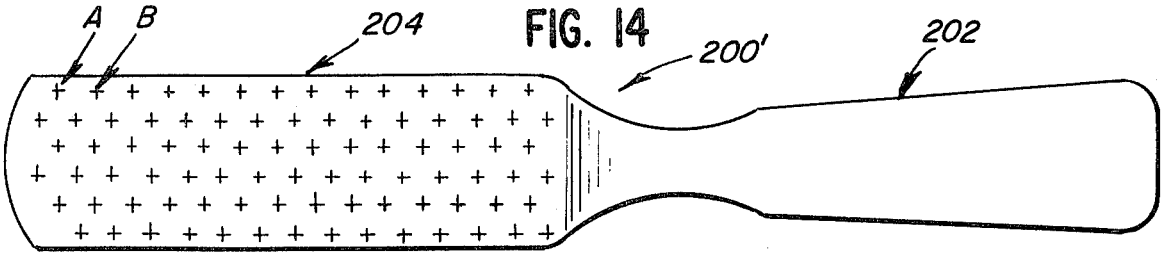
FIG. 14 is a plane view of the bottom of still a further embodiment of a brush of the present invention.
Figure 15:
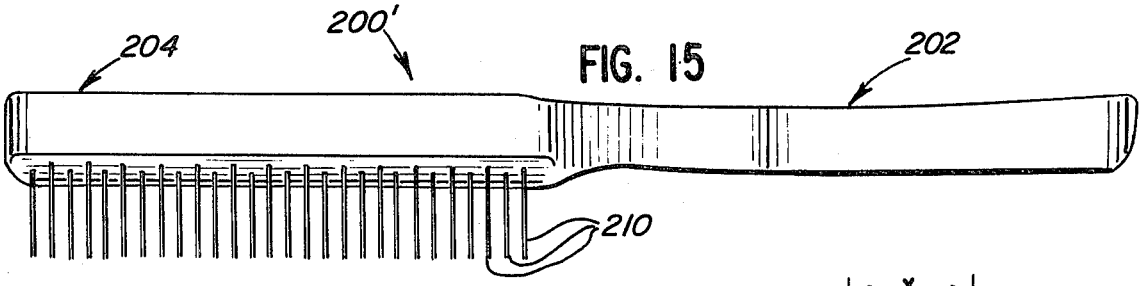
FIG. 15 is a side elevational view of the brush of FIG. 14.
Figure 16:
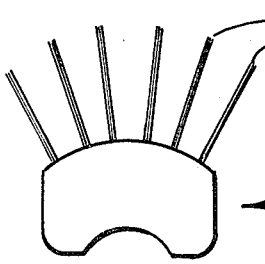
FIG. 16 is an end view of the brush of FIG. 14.

The additional embodiment of the brush of the present invention is designated generally by reference numeral 200' in FIGS. 14–16. The brush 200' includes a handle portion 202 and a head portion or bristle holder 204. As best illustrated in FIG. 15, the brush has monofilament bristles arranged in clusters of bristles 210. In FIG. 14, each cluster of bristles 210 is only diagramatically represented by a cross mark, two of which cross marks are designated by the reference letters A and B in FIG. 14.

Each cluster of bristles 210 contains a plurality of bristles that are secured to the brush head 204. The bristles in each cluster are identical to the bristles 140 described above with reference to FIGS. 1–13 and the bristles in each cluster are arranged to project outwardly from the brush in a generally parallel configuration in the same manner as the bristles of the brush embodiments described above with reference to FIGS. 1–13. The bristles in each cluster are thus arranged to provide the advantages of the brush structures described above with reference to FIGS. 1–13 and to eliminate the pressure point problem associated with conventional tufted bristle brushes.

The brush 200' may be made from a variety of suitable materials, such as thermoplastic polymer materials, and the bristles are suitably secured in bristle-receiving openings. The bristle-receiving openings will next be described in detail with references to FIGS. 17–23.

Each one of the FIGS. 17–23 shows a corner portion of a brush, generally similar to the brush 200' described above with reference to FIGS. 14–16, and with the bristles removed to better illustrate the bristle-receiving openings in the brush. Each brush is designated generally by the references numerals 200, 200A, 200B, 200C, 200D, 200E, and 200F, in the FIGS. 17, 18, 19, 20, 21, 22, 23, respectively. The only difference in the brushes illustrated in the FIGS. 17–23 is in the configuration of the bristles openings, all of which openings are designated by reference numeral 222 and all of which are arranged in clusters designated by the reference numeral 220.

The center of each cluster 220 is indicated by a cross mark designated generally by reference letter A or reference letter B corresponding to the reference letters A and B, respectively, in FIG. 14. The clusters 220 are preferably arranged in generally parallel rows along the length of the brush with the clusters in adjacent rows being staggered relative to one another. The openings 222 in all of the clusters 200 preferably have a circular configuration of substantially the same diameter.

Figure 17:
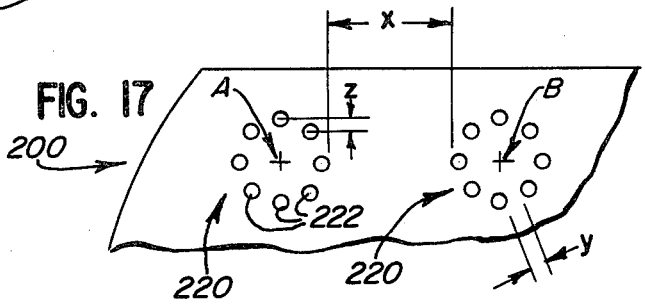
FIGS. 17–23 are enlarged, fragmentary, views of the bottom corners of various embodiments of brushes shown with the bristles removed, each embodiment being generally similar to the brush of FIG. 14 but each having a different bristle-receiving opening cluster configuration.

The brush 200 in FIG. 17 has the openings 222 of each cluster 220 arranged with the centers of the openings in a locus defining a circle. Each cluster 220 can also be regarded as having five rows of openings 222 with the rows arranged parallel to the length of the brush. The middle row of each cluster has two openings, the two outer or exterior rows of each cluster have one opening, and each interior row between the middle row and each outer row has two openings.

The centers of the openings in each interior row between the middle row and an outer row are offset in two mutually perpendicular directions from the center of the one opening in one of the outer rows. The "offset distance" z (FIG. 17) between an outer row and the adjacent interior row in the direction normal to the rows of openings in the cluster (as measured between the centerlines of the openings) is less than the diameter of the openings. Thus, the opening of an outer row can be said to "overlap" the interior adjacent row. In contrast, it can be seen that the openings in the interior rows do not overlap the middle row of openings.

In FIG. 17, the length of the middle row of openings exceeds the length of the other rows of openings. Further, each outer or exterior row of openings, though each containing only one opening, has a length that is less than the lengths of the other rows.

The distance between adjacent openings 222 in each cluster and the closet openings in adjacent clusters in the same row along the brush is designated in FIG. 17 by the dimension x. The distance between adjacent openings 222 in a given cluster 220 is designated in FIG. 17 by the dimension y. Preferably, the dimension x is greater than the dimension y.

Figure 18:
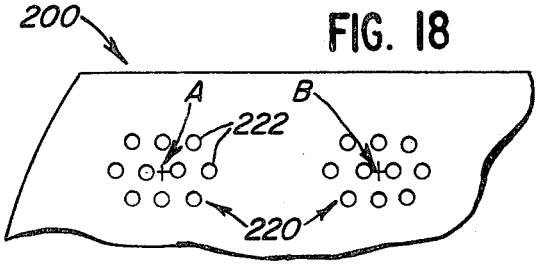

Another novel cluster opening configuration is illustrated in FIG. 18 for a brush 200A that is substantially similar to the brush 200' illustrated in FIGS. 14–16 described above.

In the embodiment illustrated in FIG. 18, the openings 222 in each cluster 220 are arranged in three rows with each row oriented parallel to the main rows of clusters and hence, parallel to the length of the brush 200A. Each of the two outer or exterior rows of openings in each cluster contains three openings. The middle row of openings in each cluster contains four openings and has a length greater than either of the outer rows. The centers of the openings in adjacent rows are offset in the longitudinal direction along the length of the rows.

Figure 19:
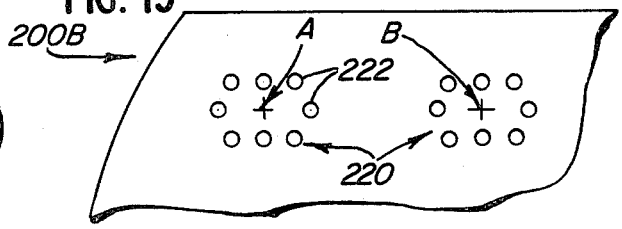

In the embodiment of the brush 200B illustrated in FIG. 19, the openings 222 are arranged in three rows extend parallel to the length of the brush. The middle row contains only two openings and each outer or exterior row contains three openings. Nevetheless, the length of the middle row of openings exceeds the length of the exterior or outer rows of openings.

Figure 20:
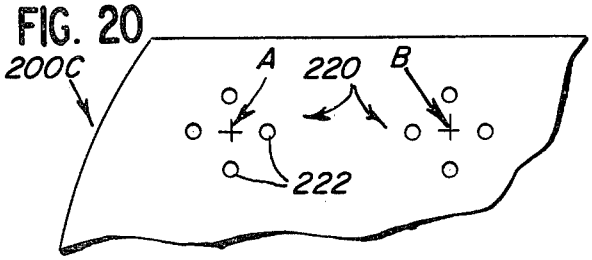

In the embodiment illustrated in FIG. 20, the brush 200C has three rows of openings in each cluster. Each row extends parallel to the length of the brush. The outer rows each have one opening and the middle row has two openings. The length of each outer row is less than the length of the middle row. The openings can be regarded as being arranged at the vertices of a square planar figure.

Figure 21:
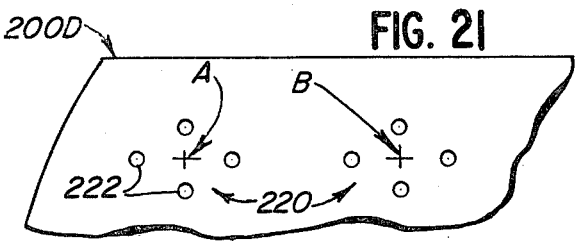

In the embodiment illustrated in FIG. 21, the brush 200D has the openings 222 in each cluster 220 arranged in three rows extending parallel to the length of the brush. The middle row has two openings and the two outer or exterior rows have one opening each. The length of each outer row of openings in each cluster is less than the length of the other rows of openings in the cluster. Each cluster 220 can also be regarded as having openings that are arranged at the vertices of a diamond-shaped planar figure or on the locus of an ellipse.

Figure 22:
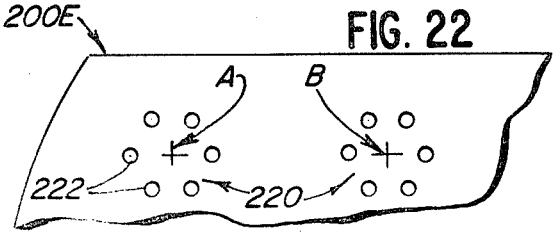

In FIG. 22 the brush 200E has three rows of openings when the rows are regarded as running parallel to the length of the brush (and hence, parallel to the lengths of the rows of opening clusters along the brush). The middle row of each cluster has two openings and each of the two outer rows of each cluster have two openings. The openings may be regarded as being arranged at the vertices of a hexagon planar figure. The outer rows of openings in each cluster are shorter than the middle row.

Figure 23:
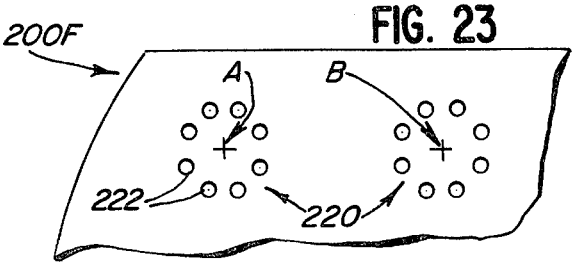

In the embodiment illustrated in FIG. 23, the brush 200F has the openings 222 in each cluster 220 arranged in four rows with two outer rows and two inner rows. The rows extend parallel to the length of the brush (and hence, parallel to the length of the rows of opening clusters along the brush). Each row of openings in each cluster has two openings and the openings can be regarded as being arranged at the vertices of an octagon planar figure. The outer rows of openings in each cluster are shorter than the inner rows.

In each of the cluster opening configurations described with reference to FIGS. 17–23, the rows of openings in each cluster have been regarded as extending parallel to the length of the brush and parallel to the rows of openings clusters along the brush. It is to be realized that the cluster opening configuration may be oriented so that the rows of openings in each cluster are positioned at an angle relative to the length of the brush (and hence, to the rows of clusters along the brush).

Further, it is to be recognized that a cluster may be formed with openings arranged in configurations other than those illustrated in FIGS. 17–23 but still in accordance with the teachings of the present invention.

Also the spacing between the openings in each row in each cluster need not be uniform. Similarly, the spacing between rows in each cluster need not be uniform. Also, the spacing between the clusters of openings in each row along the brush need not be uniform. Further, the spacing between adjacent rows of clusters need not be uniform.

In addition, the openings need not be arranged in rows per se. Further, only one large cluster may be provided instead of a plurality of clusters as previously described.

While the present invention has been herein described in terms of a hairbrush, it should be appreciated that certain principles of the present invention are applicable to other types of brushes, such as commercial and industrial brushes, brooms and the like. And, while the invention has been described in terms of a brush having retractable bristles, certain figures of the present invention are applicable to brushes having nonretractable bristles.

It will be understood that various changes and modifications can be made in the details of construction, manufacture and use, without departing from the spirit of the invention, especially as defined in the following claims.

I claim:

1. A brush having retractable bristles comprising:

(a) a casing defining an arcuate panel having a plurality of openings therein, (b) a cradle member positioned in the casing, said cradle carrying a plurality of elongate support members rotatable with respect to the cradle member, (c) a plurality of bristles mounted on the elongate support members, with each of the bristles extending into one of the openings in said panel in a close fitting relationship, and (d) means to retract the bristles into the casing through the openings, said means including a wing member mounted for sliding movement within the casing, said wing member having cam slots therein, said cradle member being mounted in the casing and having follower means thereon engaging said cam slots whereby advancing the wing member in one direction within the casing operates to retract the bristles into the casing through the openings, thereby causing the elongate support members to rotate relative to the cradle and thereby prevent the bristles from being subjected to excessive deformation while the openings exert a cleaning action on the bristles to clean foreign matter therefrom, and advancing the wing member in the opposite direction within the casing operates to extend the bristles from the casing.

2. A brush as defined in claim 1 which includes a handle.

3. A brush as defined in claim 1 which includes handle means to advance the wing member within the casing to retract and extend the bristles therefrom.

4. A brush as defined in claim 1 which includes locking means to secure the slotted wing member within the casing, with the bristles being locked in the extended position and with the bristles being locked in the retracted position.

5. A brush comprising: a body having wall means defining an internal chamber, said walls means including a bottom wall having a plurality of openings therein establishing communication between said chamber and the exterior of said body, a bristle holder within the internal chamber of said body, a plurality of bristles carried by said bristle holder, each bristle being aligned with one of said openings, means for moving said bristle holder toward and away from said bottom wall to move said bristles between an operative position wherein the free ends of the bristles are disposed outwardly of the outer surface of said bottom wall to a retracted position wherein the free ends of the bristles are disposed at least at the level of the outer surface of said bottom wall, said bottom wall having an arcuate inner surface, said bristle holder having an arcuate outer surface adapted to be positioned in surface-to-surface contact with the arcuate inner surface of said bottom wall when said bristles are in the operative position, and recess means in both of said surfaces in alignment with said openings to prevent kinking of said bristles when said bristles are in the operative position.

6. A brush as defined in claim 5 wherein said openings are arranged into a plurality of rows of clusters of closely spaced individual openings, said recess means being defined by a groove in each of said surfaces in alignment with each row of openings.

7. A brush comprising: a rigid, solid body having a bottom surface, a plurality of openings in said body extending upwardly of said bottom surface perpendicular thereto, said openings being arranged into a plurality of clusters of closely spaced individual openings and said body being substantially imperforate between said clusters of individual openings, said clusters being arranged in a plurality of substantially parallel, spaced-apart rows, the distance between the closest openings in adjacent clusters in two adjacent rows being greater than the distance between the adjacent openings of a given cluster, the distance between the closest openings in adjacent clusters in the same row being greater than the distance between the adjacent openings of a given cluster, said openings in each cluster being arranged in at least three parallel rows, each said row of openings in each said cluster having at least one opening with the openings in each row of each cluster being offset relative to the openings in at least one adjacent row in the cluster, the outer rows of openings in each cluster having lengths less than the lengths of the other rows of openings in the cluster, a single slender elongate monofilament bristle of a given flexibility extending through each of said openings, said bristles each having a uniform cross-sectional dimension from said one end thereof to an opposite free end, said bristles projecting outwardly of said bottom surface in an operative position and disposed substantially parallel with one another at least along the length of said brush and perpendicular to said bottom surface, the coaction among (a) bristle flexibility, (b) bristle cross-sectional dimension, (c) bristle projecting length, and (d) spacing and pattern of said openings in a given cluster collectively providing means for disposing the bristles in the given cluster in mutually supportive relationship with one another in said operative position when said bristles are flexed, said openings being positioned in close diametric relationship to said bristles to define means for retaining the bristles of each cluster spaced from one another at least adjacent said bottom surface to prevent the formation of pressure points, and securement means for retaining each bristle within its opening.

8. A brush as set forth in claim 7 wherein said bottom surface is arcuate.

9. A brush as set forth in claim 7 wherein said openings and said bristles are circular in cross-section.

10. A brush as set forth in claim 9 wherein the radial clearance between said bristles and said openings is in the range of 0.0015–0.010 inches.

11. A brush as defined in claim 7 wherein said body includes a top surface and a sidewall extending upwardly from said top surface at the periphery thereof, and means closing the upper end of said sidewall to form a hollow chamber, said securement means being located within said chamber.

12. A brush as defined in claim 7 including means for moving said bristles relative to said body from a retracted position wherein the free ends of said bristles are moved upwardly to at least the level of said bottom surface to said operative position wherein said bristles project outwardly of said bottom surface.

13. The brush as defined in claim 7 in which each said cluster of openings includes three rows of openings, the middle row of each said cluster having two openings and the two outer rows of each said cluster having one opening.

14. The brush as defined in claim 13 in which said openings in each cluster are arranged at the vertices of a square planar figure.

15. The brush as defined in claim 13 in which the openings in each cluster are arranged at the vertices of a diamond-shaped planar figure.

16. The brush as defined in claim 7 in which the openings in each said cluster are arranged in five rows, said five rows being arranged in two exterior rows, a middle row, and two interior rows, each said interior row being located between said middle row and one of said exterior rows, each said exterior row containing one opening, each said interior row containing two openings, and said middle row containing two openings, each said opening in all of said rows having a circular configuration of substantially the same diameter, the centers of the openings of each said interior row being offset from the center of the one opening of one of said exterior rows in two mutually perpendicular directions, and the distance that the center of the one opening in an exterior row is offset from the openings in an adjacent interior row in one of the two mutually perpendicular directions being less than the diameter of said openings.

17. The brush as defined in claim 7 in which said openings in each cluster are arranged in four rows with two outer rows and two inner rows, each said row having two openings, the openings in the four rows being arranged at the vertices of an octagon planar figure.

18. The brush as defined in claim 7 in which each said cluster has three rows of openings arranged in two outer rows and one middle row, said middle row having two openings and said two outer rows each having two openings, said openings in each cluster being arranged at the vertices of a hexagon planar figure.

19. The brush as defined in claim 7 in which said openings in each cluster are arranged in said rows with the centers of the openings in a locus defining an ellipse.

20. The brush as defined in claim 7 in which the openings in each cluster are arranged in said rows with the centers of the openings in a locus defining a circle.

21. A brush comprising: a synthetic plastic body having a bottom surface and a top surface and defining a plurality of grooves generally parallel to, and spaced from, said bottom surface, a plurality of openings in said body extending between said bottom surface and said grooves, said openings being perpendicular to at least said bottom surface, a single slender elongate synthetic plastic monofilament bristle extending through each of said openings, bristle holding means having at least one operative position relative to said body above the top surface of said body for retaining one end of said bristle laterally displaced from its corresponding opening to permit the bristle to extend at an angle in one of said grooves and out of said opening, said bristles and said openings having the same cross-sectional configuration and said bristles being of uniform cross-sectional dimension from said one end to an opposite free end, said bristles projecting outwardly of said bottom surface in an operative position and disposed substantially parallel to one another at least along the length of said brush and perpendicular to said bottom surface, the walls of said openings being spaced sufficiently closely to said bristles adjacent said one end to provide means for assisting in retaining the bristles in parallel relationship at least adjacent said bottom surface and to define means for preventing said bristles from converging adjacent said bottom surface thereby precluding the formation of pressure points, the coaction among (a) bristle flexibility,
(b) bristle cross-sectional dimension,
(c) bristle projecting length, and
(d) spacing and pattern of said openings collectively providing means for disposing said bristles in mutual supportive relationship with one another in said operative position when said bristles are flexed.

22. A brush as defined in claim 21 in which said openings are arranged into a plurality of clusters of closely spaced individual openings with said body being substantially imperforate between said clusters of individual openings.

23. A brush as set forth in claim 22 wherein said bristle clusters are arranged in rows, with the clusters in adjacent rows being staggered relative to one another.

24. A brush comprising: a body having wall means defining an internal chamber, said wall means including a bottom wall having a plurality of openings therein establishing communication between said chamber and the exterior of said body, a bristle holder within the internal chamber of said body, a plurality of bristles carried by said bristle holder, each bristle being aligned with one of said openings, means for moving said bristle holder toward and away from said bottom wall to move said bristles between an operative position wherein the free ends of the bristles are disposed outwardly of the outer surface of said bottom wall to a retracted position wherein the free ends of the bristles are disposed at least at the level of the outer surface of said bottom wall, said means for moving said bristle holder toward and away from said bottom wall including a cam member having slot means therein, said cam member being mounted for sliding movement in said internal chamber, said bristle holder having follower means therein engaging said slot means, a handle mounted for reciprocating movement relative to said body between a retracted position where a major portion of the handle is disposed within said internal chamber and an extended position where a major portion of the handle is positioned outwardly of said body, connection means between said handle and said cam member including lost motion means, whereby said cam member is not moved until said handle has moved to an intermediate position between its said retracted and extended positions and said cam member is thereafter slidably moved when said handle is reciprocated to thereby move said bristle holder, said openings and said bristles having the same cross-sectional configuration, said bristles being of substantial uniform cross-sectional dimension throughout their length and smaller than the cross-sectional dimension of said openings, and the clearance between each bristle and its opening being sufficiently small that said bristles are scraped and cleaned of extraneous material when said bristles are moved to said retracted position.

25. A hair brush comprising: a generally rigid body having a bottom surface, a plurality of openings in said body extending upwardly of said bottom surface and generally perpendicularly thereto, said openings being arranged in plural rows of plural clusters of relatively closely spaced individual openings, a single slender elongate monofilament bristle of a given cross-sectional configuration and flexibility extending through each of said openings, said bristles projecting outwardly of said bottom surface in an operative position and disposed substantially parallel with one another at least along the length of said brush, the ratio of the largest cross-sectional dimension of one of said bristles to the spacing between said one bristle and any closest other bristle being in an effective range that permits the coaction among (a) bristle flexibility, (b) bristle cross-sectional configuration and dimension, (c) bristle projecting length, and (d) spacing and pattern of said openings to collectively provide means for disposing the bristles in mutually supportive relationship with one another in said operative position when said bristles are flexed, a ratio of about 1:2 being in said effective range for a bristle having a circular cross-section with a diameter of 0.02 inch, said openings and said bristles having substantially the same cross-sectional configuration and dimensions and said openings being positioned in sufficiently closely spaced relationship to said bristles to define means for retaining the bristles of each cluster spaced from one another at least adjacent said bottom surface to prevent the formation of pressure points, and securement means for retaining each bristle within its opening.

26. A brush as defined in claim 25 wherein said openings are arranged in a plurality of clusters, wherein the openings in each cluster are arranged in rows with at least one opening in each row, and wherein the distance between the closest openings in adjacent clusters is greater than the distance between adjacent openings of a given cluster.

* * * * *